US009064459B2

(12) United States Patent
Ha et al.

(10) Patent No.: US 9,064,459 B2
(45) Date of Patent: Jun. 23, 2015

(54) DISPLAY APPARATUS AND BRIGHTNESS ADJUSTING METHOD THEREOF

(75) Inventors: Tae-hyeun Ha, Suwon-si (KR); Han Feng Chen, Suwon-si (KR); Jun-ho Sung, Seoul (KR); Yung-jun Park, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 2155 days.

(21) Appl. No.: 12/054,940

(22) Filed: Mar. 25, 2008

(65) Prior Publication Data

US 2009/0002400 A1 Jan. 1, 2009

Related U.S. Application Data

(60) Provisional application No. 60/947,112, filed on Jun. 29, 2007.

(30) Foreign Application Priority Data

Sep. 7, 2007 (KR) ..... 10-2007-0091174

(51) Int. Cl.
*G09G 5/10* (2006.01)
*G09G 3/36* (2006.01)
*G09G 3/34* (2006.01)

(52) U.S. Cl.
CPC ..... *G09G 3/3406* (2013.01); *G09G 3/3611* (2013.01); *G09G 2320/0646* (2013.01); *G09G 2320/0653* (2013.01); *G09G 2320/066* (2013.01); *G09G 2360/16* (2013.01)

(58) Field of Classification Search
USPC ..... 345/102, 77, 690; 349/75
See application file for complete search history.

(56) References Cited

U.S. PATENT DOCUMENTS

| | | | | |
|---|---|---|---|---|
| 6,859,205 | B1 * | 2/2005 | Kishi | 345/443 |
| 8,264,447 | B2 | 9/2012 | Kimura et al. | |
| 2006/0066538 | A1 * | 3/2006 | Kasai et al. | 345/77 |
| 2006/0125771 | A1 | 6/2006 | Inuzuka et al. | |
| 2006/0214904 | A1 | 9/2006 | Kimura et al. | |
| 2007/0001941 | A1 * | 1/2007 | Umezaki et al. | 345/77 |

FOREIGN PATENT DOCUMENTS

| | | | |
|---|---|---|---|
| JP | 2005-070690 | A | 3/2005 |
| JP | 2005-241678 | A | 9/2005 |

(Continued)

OTHER PUBLICATIONS

Communication dated Sep. 4, 2013, issued by the Korean Intellectual Property Office in counterpart Korean Application No. 10-2007-0091174.

*Primary Examiner* — Charles V Hicks
*Assistant Examiner* — Jeffrey S Steinberg
(74) *Attorney, Agent, or Firm* — Sughrue Mion, PLLC

(57) ABSTRACT

A display apparatus and a brightness adjusting method thereof are provided. The display apparatus includes a panel unit which displays an image signal, a backlight unit which provides a light to the panel unit to visualize the image signal, a luminance value regulator which calculates representative values to be applied for adjusting a brightness of a plurality of partial areas of the backlight unit corresponding to the input image signal, a contrast enhancer which compensates for a brightness of the image signal compromised by the representative value through a contrast enhancement, and a pixel value compensator which compensates for pixel values of the image signal compensated using the contrast enhancement. Accordingly, the contrast ratio of the entire image can be enhanced by compensating for the brightness loss of the image signal caused from the brightness adjustment of the luminous element, and the image quality can be more finely improved.

31 Claims, 5 Drawing Sheets

(56) References Cited

FOREIGN PATENT DOCUMENTS

| | | | |
|---|---|---|---|
| JP | 2005-258403 | A | 9/2005 |
| KR | 10-2004-0028940 | A | 4/2004 |
| KR | 10-2006-0035025 | A | 4/2006 |
| KR | 10-2006-0055305 | A | 5/2006 |
| KR | 10-2006-0103399 | A | 9/2006 |

* cited by examiner

| | | | | | | | |
|---|---|---|---|---|---|---|---|
| 8.83 | 20.1 | 46.5 | 20 | 7.46 | 3.85 | 2.79 | 2.43 |
| 9.27 | 24.5 | 142 | 24.4 | 7.59 | 3.81 | 2.75 | 2.4 |
| 8.08 | 18.1 | 56.1 | 18.3 | 6.59 | 3.56 | 2.68 | 2.42 |
| 6.35 | 10.4 | 16.6 | 10.3 | 4.84 | 3.2 | 2.54 | 2.34 |
| 4.92 | 5.26 | 7.87 | 5.81 | 3.79 | 2.79 | 2.5 | 2.33 |
| 4.1 | 4.5 | 4.94 | 4.19 | 3.06 | 2.56 | 2.4 | 2.29 |
| 3.52 | 3.66 | 3.76 | 3.53 | 2.94 | 2.47 | 2.33 | 2.25 |
| 3.52 | 3.74 | 3.89 | 3.73 | 3.16 | 2.75 | 2.49 | 2.24 |

DISPLAY APPARATUS AND BRIGHTNESS ADJUSTING METHOD THEREOF

CROSS-REFERENCE TO RELATED APPLICATIONS

This application claims priority from U.S. Provisional Patent Application No. 60/947,112, filed on Jun. 29, 2007, in the United States Patent and Trademark Office, and from Korean Patent Application No. 10-2007-0091174, filed on Sep. 7, 2007, in the Korean Intellectual Property Office, the disclosures of which are incorporated herein by reference.

BACKGROUND OF THE INVENTION

1. Field of the Invention

Apparatuses and methods consistent with the present invention relate to a display apparatus and a brightness adjusting method thereof, and more particularly, to adjusting a brightness of part and all of an image of an input video signal.

2. Description of the Related Art

In general, a display apparatus such as a liquid crystal display (LCD) is used to display a video on a television, a notebook computer, and a desktop computer. Since the LCD cannot produce a light by itself, it displays an image using a light emitted from a separate light source. Thus, the LCD has a display panel and a luminous element comprising a backlight at the rear side of the display panel. The display panel adjusts the transmittance of the light emitted from the luminous element to thus display the image.

In the related art, a uniform backlight for uniformly illuminating the entire display panel has been used in the luminescence part of the LCD. The uniform backlight displays both the dark image and the bright image with the light of the same luminance. While an image showing a firework scene or an explosion scene partially requires a relatively high luminance, it is hard to represent the vivid image because of the lack of proper compensation.

In addition, since the light emitted from the uniform backlight comes into the display panel and causes interference, the LCD cannot display the black image of the pixel value '0' as a true black image and accordingly the contrast ratio of the entire screen decreases. Even in the dark image displayable through light of low luminance, the light of the same luminance is produced from the uniform backlight thus wasting power.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a display apparatus for adjusting a brightness of a partial area, improving a contrast of an image, and compensating for image pixels, and a brightness adjusting method of the display apparatus.

According to an aspect of the present invention, a display apparatus comprises a panel unit which displays an image signal; a backlight unit which provides a light to the panel unit to visualize the image signal; a luminance value regulator which calculates a representative value to be applied for adjusting a brightness of each partial area of the backlight unit corresponding to the input image signal; a contrast enhancer which compensates for a brightness of the image signal compromised by the representative value through a contrast enhancement; and a pixel value compensator which compensates for pixel values of the image signal compensated using the contrast enhancement.

The contrast enhancer may compensate for the loss of the brightness of the image signal with respect to the entire image and at least one of partial areas of the image using the contrast enhancement.

The contrast enhancer may compensate for a contrast of the entire image using an average representative value acquired by averaging the representative values of the partial areas, and compensate for the brightness loss of the image in the partial areas using an interpolation representative value acquired by interpolating the representative values of the partial areas using the contrast enhancement.

The display apparatus may further comprise a pre-processor which removes noise in the image signal and calculates a luminance value of the pixel at a certain position in the noise-free image signal. The luminance value regulator may calculate the representative values using an initial representative value acquired by multiplying luminance values of pixels in the partial areas by a pre-stored weight and summing the products.

The luminance value regulator may calculate the initial representative value by applying the luminance value of the partial area to the following equation:

$$BLK_{init}(k)=\min(BLK1(k),BLK2(k))$$

where $BLK_{init}(k)$ is an initial representative value in a partial area k, BLK1($k$) is a first luminance value in the partial area k, and BLK2($k$) is a second luminance value in the partial area k.

The luminance value regulator may calculate the initial representative value by applying the luminance value of the partial area to the following equation:

$$BLK_{init}(k)=w1*BLK1(k)+(1-w1)*(BLK2(k))$$

where $BLK_{init}(k)$ is an initial representative value in a partial area k, w1 is a preset weight, BLK1($k$) is a first luminance value in the partial area k, and BLK2($k$) is a second luminance value in the partial area k.

The luminance value regulator may comprise a first calculator which calculates a first brightness value to be used to compensate for the image signal by summing products of the initial representative values of the partial areas and pre-stored optical profile data; a first regulator which calculates a first adjustment value used to adjust the brightness of the image signal using the first luminance value calculated at the first calculator, the initial representative value, and a preset maximum luminance value; a second calculator which calculates a second brightness value which is a brightness value after scaling the first brightness value to be used to compensate for the image signal of which the brightness is adjusted by the first regulator; and a second regulator which calculates a second adjustment value which adjusts the brightness of the image signal of which the brightness is adjusted using the first adjustment value, using the second brightness value calculated at the second calculator, the first adjustment value, and the maximum luminance value.

The luminance value regulator may comprise a first calculator which calculates a first brightness value which is a brightness value in a specific partial area of the image signal after scaling the image signal; a first regulator which calculates a first adjustment value to adjust the brightness of the image signal in the specific partial area; a second calculator which calculates a second brightness value which is a brightness value in partial areas adjacent to the specific partial area of the image signal; and a second regulator which calculates a second adjustment value to adjust the brightness of the image signal in the partial areas adjacent to the specific partial area of the image signal.

The luminance value regulator may further comprise a space filter which space-filters the partial area of which the brightness is adjusted using the second adjustment value; and a time filter which time-filters the space-filtered partial area.

The pixel value compensator may comprise an interpolator which calculates a brightness value of the partial area from the representative value, and calculates an interpolation representative value which is an interpolated brightness value of the pixel at a certain position by applying one of a bi-cubit interpolation and a bi-linear interpolation to the calculated brightness value; a compensation coefficient calculator which calculates a compensation coefficient used to compensate for the pixel values of the image signal using the interpolation representative value and the luminance value of the pixels of the partial area; and a compensator which compensates for the pixel values of the image signal of which the contrast is enhanced by multiplying the compensation coefficient by the pixel values used to enhance the contrast at the contrast enhancer.

The compensation coefficient calculator may calculate a first compensation coefficient by applying the interpolation representative value to the following equation:

$$BLK_{LC}(i,j)=(Y(i,j))^{\gamma_p/BLK_{pro}(i,j)}$$

where $BLK_{LC}(i,j)$ is the first compensation coefficient of an (i, j)-th pixel, Y(i,j) is a luminance value of the pixel at (i, j), and $BLK_{pro}(i,j)$ is an interpolation representative value of the pixel at (i, j).

The compensation coefficient calculator may calculate a saturation coefficient by applying the first compensation coefficient to the following equation:

$$BLK_{sat}(i,j)=\begin{cases} BLK_{pro}(i,j)-g4\cdot(Y(i,j))^{\gamma_p}-BLK_{pro}(i,j) & \text{if } (Y(i,j))^{\gamma_p}>BLK_{pro}(i,j) \\ \text{else} & \\ BLK_{pro}(i,j) & \end{cases}$$

where $BLK_{sat}(i,j)$ is a saturation coefficient of the (i, j)-th pixel, Y(i,j) is the luminance value of the (i, j)-th pixel, $BLK_{pro}(i,j)$ is the interpolation representative value of the (i, j)-th pixel, g4 is a preset control parameter, and $\gamma_p$ is a preset gamma parameter.

The compensation coefficient calculator may calculate the compensation coefficient used to compensate for the pixel values of the image signal by calculating a second compensation coefficient by applying the saturation coefficient to the following equation:

$$PC_{gain}(i,j)=(1/BLK_{sat}(i,j))^{1/\gamma_p,BLK_{LC}(i,j)}$$

where $PC_{gain}(i,j)$ is a second compensation coefficient of the (i, j)-th pixel, $BLK_{sat}(i,j)$ is a saturation coefficient of the (i, j)-th pixel, $BLK_{LC}(i,j)$ is a first compensation coefficient of the (i, j)-th pixel, and $\gamma_p$ is the preset gamma parameter.

The pixel value compensator may compensate for the pixel values of the image signal by adjusting the pixel values to make a dark pixel less dark and make a bright pixel brighter among the pixels of the image signal compensated using the contrast enhancement.

According to an aspect of the present invention, a brightness adjusting method of a display apparatus comprises a first operation for calculating a representative value to be applied to adjust a brightness of partial areas of a luminous element which produces light to a panel, corresponding to an input image signal; a second operation for compensating for a brightness of the image signal compromised by the representative value using a contrast enhancement; and a third operation for compensating for pixel values of the image signal compensated using the contrast enhancement.

The first operation may compensate for the loss of the brightness of the image signal with respect to the entire image and at least one of partial areas of the image using the contrast enhancement.

The first operation may compensate for a contrast of the entire image using an average representative value acquired by averaging the representative values of the partial areas, and compensate for the brightness loss of the image using an interpolation representative value acquired by interpolating the representative values of the partial areas using the contrast enhancement.

The brightness adjusting method may further comprise, before the first operation, removing noise from the image signal and calculating a luminance value of the pixel at a certain position in the noise-free image signal. The first operation may calculate the representative value using an initial representative value acquired by multiplying luminance values of pixels in the partial areas by a pre-stored weight and summing the products.

The first operation may calculate the initial representative value by applying the luminance value of the partial area to the following equation:

$$BLK_{init}(k)=\min(BLK1(k),BLK2(k))$$

where $BLK_{init}(k)$ is an initial representative value in a partial area k, BLK1(*k*) is a first luminance value in the partial area k, and BLK2(*k*) is a second luminance value in the partial area k.

The first operation may calculate the initial representative value by applying the luminance value of the partial area to the following equation:

$$BLK_{init}(k)=w1*BLK1(k)+(1-w1)*(BLK2(k))$$

where $BLK_{init}(k)$ is an initial representative value in a partial area k, w is a preset weight, BLK1(*k*) is a first luminance value in the partial area k, and BLK2(*k*) is a second luminance value in the partial area k.

The first operation may comprise calculating a first brightness value to be used to compensate for the image signal by summing products of the initial representative values of the partial areas and pre-stored optical profile data; calculating a first adjustment value used to adjust the brightness of the image signal using the calculated first luminance value, the initial representative value, and a preset maximum luminance value; calculating a second brightness value which is a brightness value after scaling the first brightness value to be used to compensate for the image signal of which the brightness is adjusted using the first adjustment value; and calculating a second adjustment value which adjusts the brightness of the image signal of which the brightness is adjusted using the first adjustment value, using the calculated second luminance value, the first adjustment value, and the maximum luminance value.

The first operation may comprise calculating a first brightness value which is a brightness value in a specific partial area of the image signal after scaling the image signal; calculating a first adjustment value to adjust the brightness of the image signal in the specific partial area; calculating a second brightness value which is a brightness value in partial areas adjacent to the specific partial area of the image signal; and calculating a second adjustment value to adjust the brightness of the image signal in the partial areas adjacent to the specific partial area of the image signal.

The first operation may further comprise space-filtering the partial area of which the brightness is adjusted using the second adjustment value; and time-filtering the space-filtered partial area.

The first operation may comprise calculating a brightness value of the partial area from the representative value, and calculating an interpolation representative value which is an interpolated brightness value of the pixel at a certain position by applying one of a bi-cubit interpolation and a bi-linear interpolation to the calculated brightness value; calculating a compensation coefficient used to compensate for the pixel values of the image signal using the interpolation representative value and the luminance value of the pixels of the partial area; and compensating for the pixel values of the image signal of which the contrast is enhanced by multiplying the compensation coefficient by the pixel values used to enhance the contrast.

The compensation coefficient calculating operation may calculate a first compensation coefficient by applying the interpolation representative value to the following equation:

$$BLK_{LC}(i,j)=(Y(i,j))^{\gamma_p/BLK_{pro}(i,j)}$$

where $BLK_{LC}(i,j)$ is the first compensation coefficient of an (i, j)-th pixel, Y(i,j) is a luminance value of the pixel at (i, j), and $BLK_{pro}(i,j)$ is an interpolation representative value of the pixel at (i,j).

The compensation coefficient calculating operation may calculate a saturation coefficient by applying the first compensation coefficient to the following equation:

$$BLK_{sat}(i,j)=\begin{cases} BLK_{pro}(i,j)-g4\cdot(Y(i,j))^{\gamma_p}-BLK_{pro}(i,j) & \text{if } (Y(i,j))^{\gamma_p}>BLK_{pro}(i,j) \\ \text{else} & \\ BLK_{pro}(i,j) & \end{cases}$$

where $BLK_{sat}(i,j)$ is a saturation coefficient of the (i, j)-th pixel, Y(i,j) is the luminance value of the (i, j)-th pixel, $BLK_{pro}(i,j)$ is the interpolation representative value of the (i, j)-th pixel, g4 is a preset control parameter, and $\gamma_p$ is a preset gamma parameter.

The compensation coefficient calculating operation may calculate the compensation coefficient used to compensate for the pixel values of the image signal by calculating a second compensation coefficient by applying the saturation coefficient to the following equation:

$$PC_{gain}(i,j)=(1/BLK_{sat}(i,j))^{1/\gamma_p,BLK_{LC}(i,j)}$$

where $PC_{gain}(i,j)$ is a second compensation coefficient of the (i, j)-th pixel, $BLK_{sat}(i,j)$ is a saturation coefficient of the (i, j)-th pixel, $BLK_{LC}(i,j)$ is a first compensation coefficient of the (i, j)-th pixel, and $\gamma_p$ is the preset gamma parameter.

The third operation may compensate for the pixel values of the image signal by adjusting the pixel values to make a dark pixel less dark and make a bright pixel brighter among the pixels of the image signal compensated using the contrast enhancement.

The brightness adjusting method may further comprise, after the third operation, dithering a flickering of the image signal of which the pixel values are compensated in the third operation, and adjusting a white balance.

BRIEF DESCRIPTION OF THE DRAWING FIGURES

The above aspects and other aspects of the present invention will become apparent and more readily appreciated from the following description of exemplary embodiments, taken in conjunction with the accompany drawings, in which.

DETAILED DESCRIPTION OF EXEMPLARY EMBODIMENTS

Figure 1:
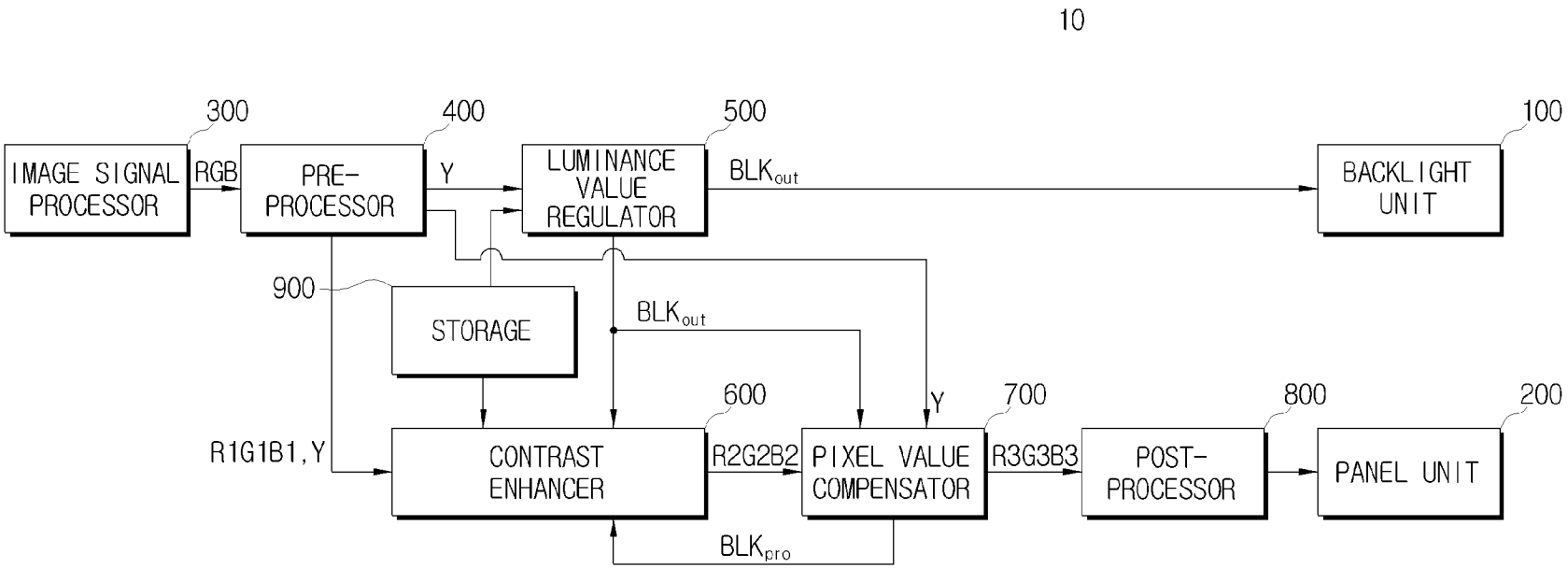
FIG. 1 is a simplified block diagram of a display apparatus according to an exemplary embodiment of the present invention.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in excessive detail since they would obscure the invention unnecessarily.

FIG. 1 is a simplified block diagram of a display apparatus according to an exemplary embodiment of the present invention.

The display apparatus of FIG. 1 comprises a backlight unit 100, a panel unit 200, an image signal processor 300, a preprocessor 400, a luminance value regulator 500, a contrast enhancer 600, a pixel value compensator 700, a post-processor 800, and a storage 900.

The backlight unit 100 comprises a plurality of luminous bodies emitting the light. The backlight unit 100 is split into a plurality of partial areas. For example, the backlight unit 100 can be split into 64 (=8×8) partial areas. The partial area comprises a plurality of luminous bodies controlled to illuminate the same brightness. The luminous body mostly employs a light emitting diode (LED) having a rapid response speed. The luminous body can also employ a code cathode fluorescent lamp (CCFL), a field effect diode (FED), and a surface-conduction electron-emitter display (SED).

The panel unit 200 adjusts the transmittance of the light emitted from the backlight unit 100 to visualize and display an image signal in a screen. The panel unit 200 is disposed such that two substrates having electrodes face each other and a liquid crystal material is injected between the two substrates. When a voltage is applied to the two electrodes, an electric field is generated. Accordingly, molecules of the liquid crystal material injected between the two substrates are moved to thus regulate the transmittance of the light.

The image signal processor 300 outputs an RGB image signal by properly processing the incoming image signal according to a resolution of the panel unit 200.

The pre-processor 400 calculates a R1G1B1 image signal from the RGB image signal output from the image signal processor 300 by removing noise, and calculates a luminance value of a pixel at a certain position satisfying Equation 1 below from the noise-free R1G1B1 image signal. The pre-processor 400 can remove the noise from the RGB image signal using a low pass filter (LPF).

$$Y(i,j)=\max(R(i,j),G(i,j),B(i,j)) \quad \text{[Equation 1]}$$

In Equation (1), Y(i,j) denotes a luminance value of a pixel at (i,j), R(i,j) denotes an R pixel value of the pixel at (i,j), G(i,j) denotes a G pixel value of the pixel at (i,j), and B(i,j) denotes a B pixel value of the pixel at (i,j). Equation 1 signifies that the greatest pixel value of the RGB pixel values at (i,j) is selected as the luminance value of the pixel at (i,j).

The luminance value regulator 500 calculates an initial representative value for each partial area k using the luminance value of the pixel output from the pre-processor 400. In doing so, by referring to the storage 900, the luminance value regulator 500 calculates an average value by applying a weight to the brightness of the corresponding partial area image based on a pre-stored weight lookup table to thus acquire the initial representative value $BLK_{init}(k)$ of each partial area, and calculates a representative value $BLK_{out}$ of each partial area using the calculated initial representative value. Herein, the weight lookup table arranges preset weights W(Y(i,j)) corresponding to the respective luminance values Y(i,j) of the pixels.

The contrast enhancer 600 compensates for the representative value $BLK_{out}$ of each partial area output from the luminance value regulator 500 using a contrast enhancement. The contrast enhancement is an image processing scheme which increases the contrast ratio through a linear or non-linear conversion.

Specifically, by referring to the first and second lookup tables pre-stored to the storage 900, the contrast enhancer 600 calculates a pixel value R2G2B2 used for the contrast compensation using an interpolation representative value $BLK_{pro}$ and an average representative value $BLK_{mean}$ to compensate for the brightness loss of each partial area which is caused by the partial area representative value $BLK_{out}$. The first and second lookup tables comprise R1 calculated at the pre-processor 400 and R2 corresponding to the pixel luminance value Y. The first lookup table is applied to enhance the contrast of the entire image, that is, the entire screen, and the second lookup table is applied to enhance the contrast in the partial area. The first and second lookup tables comprise not only R1 but also G1, B1, G2 and B2 corresponding to the pixel luminance value Y.

The pixel value compensator 700 calculates R3G3B3 pixel value which more precisely compensates for the pixel values of the image signal compensated using R2G2B2 pixel value output from the contrast enhancer 600. In other words, the pixel value compensator 700 more finely compensates for the pixel values of the image signal to improve the image quality of the image of which the contrast ratio is enhanced through the contrast enhancer 600.

The post-processor 800 applies the dithering and the white balance to the image signal compensated using R3G3B3 which is the pixel value of the image signal output from the pixel value compensator 700.

The structure and the operation of the luminance value regulator 500 will be described in detail with reference to FIG. 2.

Figure 2:
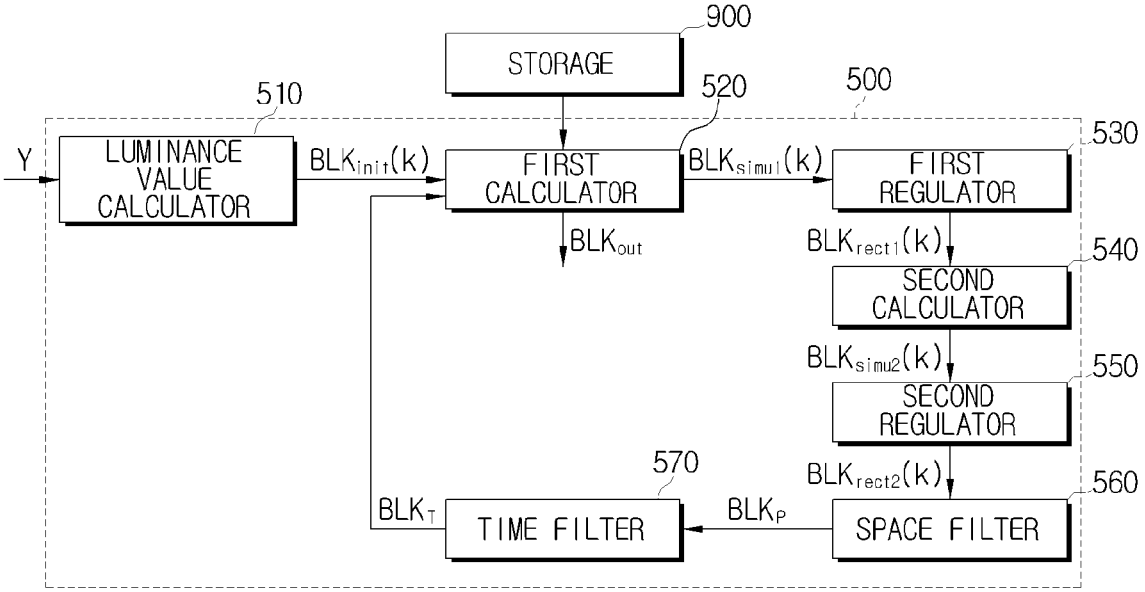
FIG. 2 is a block diagram of a luminance value regulator of the display apparatus according to an exemplary embodiment of the present invention.

FIG. 2 is a block diagram of the luminance value regulator 500 of the display apparatus according to an exemplary embodiment of the present invention.

The luminance value regulator 500 comprises a luminance value calculator 510, a first calculator 520, a first regulator 530, a second calculator 540, a second regulator 550, a space filter 560, and a time filter 570.

The luminance value calculator 510 calculates the initial representative value $BLK_{init}(k)$ for the partial area k by applying the luminance value of the pixel output from the pre-processor 400 to Equations 2, 3 and 4 below. Equation 2 expresses the weighted first luminance value in the partial area k, and Equation 3 expresses the second luminance value in the partial area k where a preset parameter is applied. The luminance value calculator 510 calculates the initial representative value in the partial area k, but not limited to the partial area. The luminance value calculator 510 calculates the initial representative value for all the partial areas.

$$BLK1(k) = f\left[\sum_{(i,j)=B_k} Y(i,\ j)\cdot W(Y(i,\ j))\right] \quad \text{[Equation 2]}$$

In Equation 2, BLK1(*k*) denotes the first luminance value in the partial area k, Y(i,j) denotes the luminance value of the pixel at (i,j), W(Y(i,j)) denotes a weight of the pixel at (i,j), which is preset in the weight lookup table, and f(x) denotes a function which limits the value x to 0~1.

$$\forall(i,j)\epsilon B_k, BLK2(k)=g1\cdot BLK2(k)+(1-g1)\cdot(Y(i,j))^{\gamma_p} \text{ if } BLK2(k)<(Y(i,j))^{\gamma_p} \quad \text{[Equation 3]}$$

In Equation 3, BLK2(*k*) denotes the second luminance value in the partial area k, Y(i,j) denotes the luminance value of the pixel at (i,j), g1 denotes a preset control parameter of an IIR filter, and $\gamma_p$ denotes a preset gamma parameter of the LCD panel.

$$BLK_{init}(k)=\min(BLK1(k),BLK2(k)) \quad \text{[Equation 4]}$$

In Equation 4, $BLK_{init}(k)$ denotes the initial representative value in the partial area k, BLK1(*k*) denotes the first luminance value in the partial area k, and BLK2(*k*) denotes the second luminance value in the partial area k. Based on Equation 4, the luminance value calculator 510 can output the minimum value of the average of luminance value BLK1(*k*) and the luminance value BLK2(*k*) in the partial area k, as the initial representative value $BLK_{init}(k)$ in the partial are k.

The luminance value calculator 510 can calculate the initial representative value $BLK_{init}(k)$ in the partial area k by applying a preset weight w1 to the average luminance value BLK1(*k*) and the luminance value BLK2(*k*) of the partial area k, as expressed in Equation 5.

$$BLK_{init}(k)=w1*BLK1(k)+(1-w1)*(BLK2(k)) \quad \text{[Equation 5]}$$

In Equation 5, $BLK_{init}(k)$ denotes the initial representative value in the partial area k and w1 denotes the preset weight.

That is, the luminance value calculator 510 can calculate the initial representative value $BLK_{init}(k)$ in the partial area k with the two methods using the minimum value and the weight.

The first calculator 520 calculates a first brightness value $BLK_{simu1}(k)$ which is a real brightness value of the image scaled by applying the brightness value of the image input from outside, by applying the initial representative value $BLK_{init}(k)$ fed from the luminance value calculator 510 to Equation 6 below. Specifically, the first calculator 520 receives the brightness value of the luminous bodies of the backlight unit 100 and calculates the first brightness value $BLK_{simu1}(k)$ which is the real brightness value of the partial area represented by the image brightness loss caused when the image is displayed with the input brightness value.

$$BLK_{simu1}(k) = \sum_{m=0}^{BLK_{NUM}} (BLK_{init}(m) \cdot P_m(k)) \quad \text{[Equation 6]}$$

Figure 3:
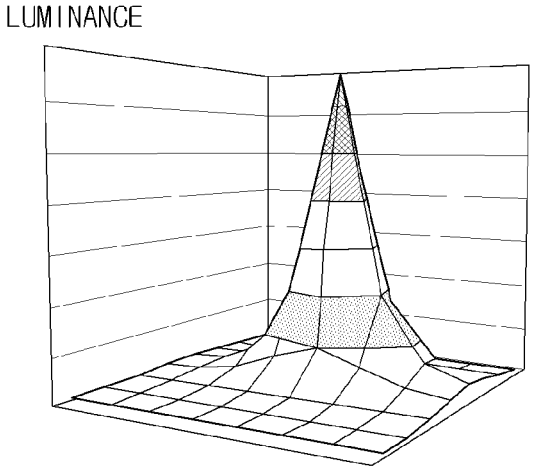
FIG. 3 depicts optical profile data stored to the display apparatus according to an exemplary embodiment of the present invention.

In Equation 6, $BLK_{simu1}(k)$ denotes the first brightness value of the partial area k, which is used for the compensation of the image signal. $BLK_{init}(m)$ denotes the initial representative value in the partial area m, $P_m(k)$ denotes the optical profile data in the partial area m, and $BLK_{NUM}$ denotes the number of partial areas. Herein, $P_m(k)$ indicates the luminance value in the partial area k when only the luminous body of the partial area m is turned on and the luminous bodies of the other partial areas are turned off. The optical profile data is pre-stored to the storage 900 as the lookup table as shown in FIG. 3. The optical profile data is pre-stored as the lookup table with respect to the R, G and B image signals respectively.

The first calculator 520 outputs as the representative value the real brightness value $BLK_{out}$ of the image signal after the partial area to which the filtered representative value $BLK_T$ fed from the time filter 570 is applied, and scaled. That is, the first calculator 520 outputs the first brightness value of the image to which the brightness adjustment and the filtering are applied in the partial area, as the representative value $BLK_{out}$.

The first regulator 530 calculates a first adjustment value $BLK_{rect1}(k)$ to adjust the brightness loss in the partial area caused by the initial representative value by applying the first brightness value $BLK_{simu1}(k)$ output from the luminance value calculator 510 to Equation 7.

$$BLK_{rect1}(k) = \begin{cases} \min(L_{MAX}, BLK_{init}(k) + g2 \cdot (BLK_{init}(k) - BLK_{simu1}(k))) & \text{if } BLK_{init}(k) > BLK_{simu1}(k) \\ \text{else} \\ BLK_{init}(k) \end{cases} \quad \text{[Equation 7]}$$

In Equation 7, $BLK_{rect1}(k)$ denotes the first adjustment value in the partial area k, $BLK_{simu1}(k)$ denotes a real brightness value in the partial area k, $BLK_{init}(k)$ denotes the initial representative value in the partial area k, g2 denotes the present control parameter, and $L_{MAX}$ denotes a preset maximum luminance value.

Figure 4:
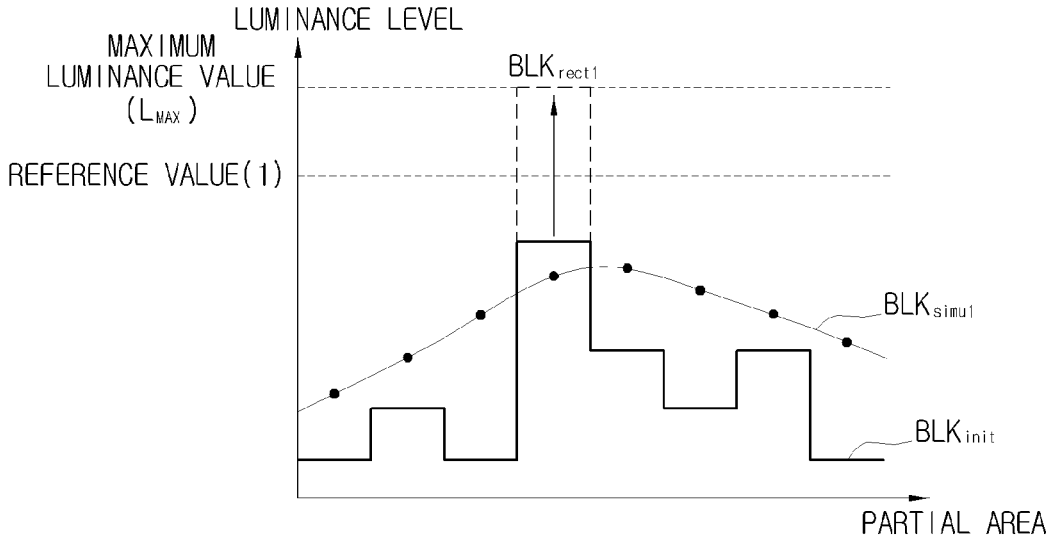
FIGS. 4 and 5 depict an image brightness adjusting method at the luminance value regulator of the display apparatus according to an exemplary embodiment of the present invention.

Since the first brightness value $BLK_{simu1}(k)$ which is the real brightness value in the partial area k is smaller than the initial representative value $BLK_{init}(k)$ in the partial area k as shown in FIG. 4, the first regulator 530 calculates the first adjustment value $BLK_{rect1}(k)$ to increase the initial representative value $BLK_{init}(k)$ to a maximum luminance value $L_{MAX}$. In doing so, when the first brightness value $BLK_{simu1}(k)$ is greater than the initial representative value $BLK_{init}(k)$, the first regulator 530 outputs the initial representative value $BLK_{init}(k)$ as the first adjustment value $BLK_{rect1}(k)$.

The second calculator 540 calculates a second brightness value $BLK_{simu2}(k-1)$, $BLK_{simu2}(k+1)$ by applying Equation 6 to the first adjustment value output from the first regulator 530. Specifically, when the brightness of the image in the partial area k is adjusted by the first adjustment value, the second calculator 540 calculates the second brightness value which is the real brightness in the partial areas (k−1) and (k+1). Namely, the second brightness value is the brightness value after the first brightness value is scaled. The second calculator 540 can calculate the brightness value $BLK_{simu2}(k-BLK_{NUM})$, $BLK_{simu2}(k+BLK_{NUM})$ of the image signal up to the number of the partial areas $BLK_{NUM}$.

The second regulator 550 calculates a second adjustment value $BLK_{rect1}(k-1)$,$BLK_{rect1}(k+1)$ in the partial areas (k−1) and (k+1) by applying the second brightness value output from the second calculator 540 to Equation 8.

$$BLK_{rect}(k-1) = \begin{cases} \min(L_{\max}, BLK_{rec1}(k-1) + g3 \cdot (BLK_{rect1}(k) - BLK_{rect}simu2(k))) & \text{if } BLK_{rect1}(k) > BLK_{simu2}(k) \\ \text{else} \\ BLK_{rect1}(k+1) \end{cases} \quad \text{[Equation 8]}$$

$$BLK_{rect}(k+1) = \begin{cases} \min(L_{\max}, BLK_{rec1}(k+1) + g3 \cdot (BLK_{rect1}(k) - BLK_{rect}simu2(k))) & \text{if } BLK_{rect1}(k) > BLK_{simu2}(k) \\ \text{else} \\ BLK_{rect1}(k+1) \end{cases}$$

In Equation 8, $BLK_{rect}(k-1)$ and $BLK_{rect}(k+1)$ denote the second adjustment value in the partial areas (k−1) and (k+1) respectively, $L_{max}$ denotes the preset maximum luminance value, $BLK_{rect1}(k-1)$ and $BLK_{rect1}(k+1)$ denote the first adjustment value in the partial areas (k−1) and (k+1) respectively, $BLK_{rect1}(k)$ denotes the first adjustment value in the partial area k, $BLK_{simu2}(k)$ denotes the real brightness in the partial area k, and g3 denotes the preset control parameter.

In further detail, when the first adjustment value $BLK_{rect1}(k)$ in the partial area k exceeds the second brightness value $BLK_{simu2}(k)$, the second regulator 550 outputs the minimum value of the operation result value of the first adjustment value of the partial area (k−1), the first adjustment value of the partial area k, the second brightness value of the partial area k, and the maximum luminance value, as the second adjustment value. When the first adjustment value $BLK_{rect1}(k)$ falls below the second brightness value $BLK_{simu2}(k)$ in the partial area k, the second regulator 550 outputs the first adjustment value of the partial area (k−1) as the second adjustment value.

The second regulator 550 calculates the second adjustment value of the partial area (k+1) in the same manner as in the partial area (k−1).

Figure 5:
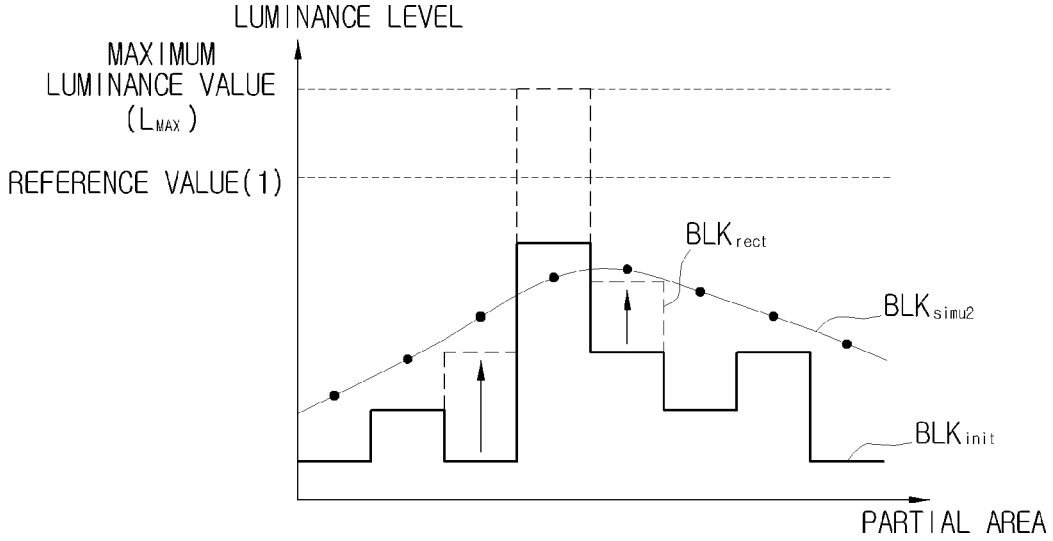

In FIG. 5, the real brightness $BLK_{simu2}(k)$ of the partial area after the brightness of the image is adjusted using the first adjustment value in the partial area k still falls below the initial representative value $BLK_{init}(k)$, whereas there is no more adjustment value because the initial representative value in the partial area k is adjusted to the maximum luminance value $L_{NUM}$. Thus, the second regulator 550 calculates the second adjustment value which adjusts the initial representative values in the partial areas (k−1) and (k+1) around the partial area k to the maximum luminance value. In doing so, the second regulator 550 can calculate the adjustment value $BLK_{rect2}(k-BLK_{NUM})$, $BLK_{rect2}(k+BLK_{NUM})$ which adjusts the image brightness up to the number of the partial areas $BLK_{NUM}$.

The space filter 560 space-filters the partial area of which the brightness is adjusted with the second adjustment value output from the second regulator 550. In detail, layers are generated in the still image because of the brightness difference of the partial areas of the backlight unit 100. To eliminate the layers, the representative value $BLK_{rect}$ adjusts the brightness in the partial area using the second adjustment value output from the second regulator 550, space-filtering through a LPF and the filtered representative value $BLK_p$ is output.

The time filter 570 time-filters the space-filtered representative value $BLK_p$. When the filtered representative value $BLK_p$ is given to each partial area of the backlight unit 100, the brightness difference of the partial areas causes flickering in moving pictures. To remove the flickering, the time filter 570 outputs the representative value $BLK_T$ to the first calculator 520 by time-filtering the representative value $BLK_p$ through an LPF.

Now, the structure and the operation of the contrast enhancer 600 are explained in detail.

Figure 6:
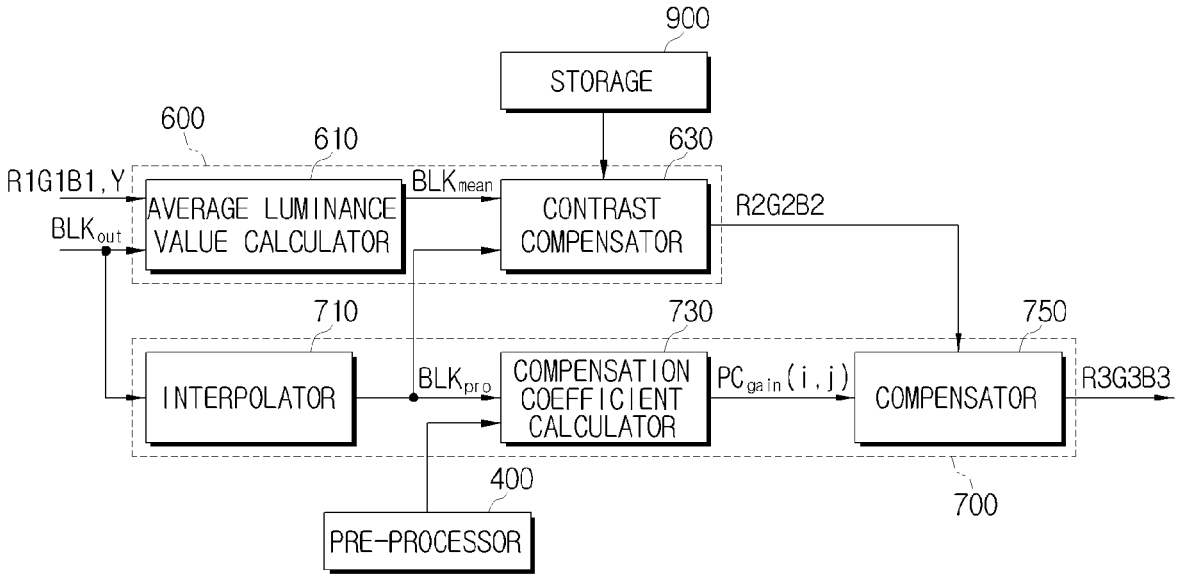
FIG. 6 is a block diagram of a contrast enhancer and a pixel value compensator of the display apparatus according to an exemplary embodiment of the present invention.

FIG. 6 is a block diagram of the contrast enhancer 600 and the pixel value compensator 700 of the display apparatus according to an exemplary embodiment of the present invention.

The contrast enhancer 600 of FIG. 6 comprises an average luminance value calculator 610 and a contrast compensator 630. The pixel value compensator 700 comprises an interpolator 710, a compensation coefficient calculator 730, and a compensator 750.

The average luminance value calculator 610 calculates an average representative value $BLK_{mean}$ which is an average value of the representative value $BLK_{out}$ fed from the first calculator 520.

Figure 7:
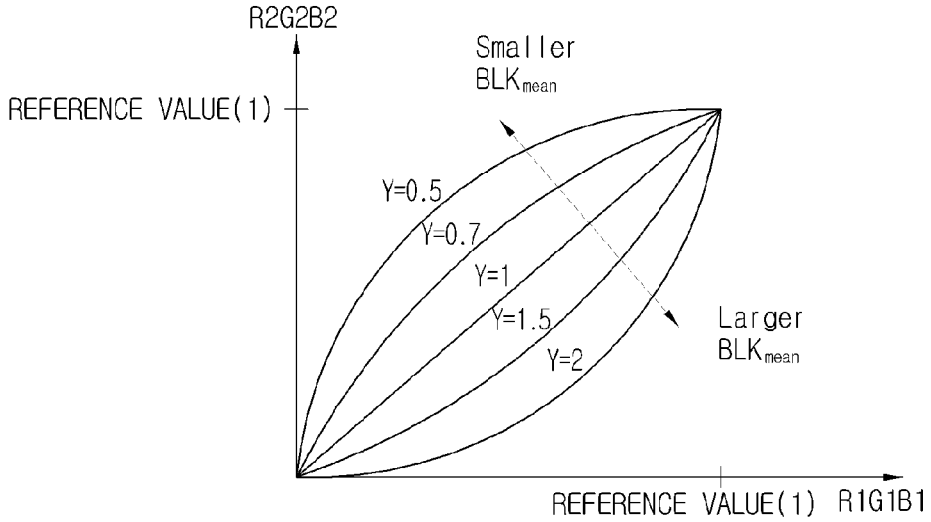
FIGS. 7 and 8 depict first and second lookup tables used to improve the image contrast at the contrast enhancer of the display apparatus according to an exemplary embodiment of the present invention.

The contrast compensator 630 calculates R2G2B2 pixel value corresponding to the average representative value $BLK_{mean}$ output from the average luminance value calculator 610, the R1G1B1 pixel value, and the pixel luminance value Y, by referring to the first lookup table pre-stored to the storage 900. FIG. 7 shows an example of the first lookup table. The contrast compensator 630 calculates the R2G2B2 pixel value corresponding to the average representative value $BLK_{mean}$, the R1G1B1 pixel value, and the pixel luminance value Y based on the first lookup table of FIG. 7.

As seen from FIG. 7, as the average representative value $BLK_{mean}$ increases, the brightness of the partial area is high, and as the average representative value $BLK_{mean}$ decreases, the brightness of the partial area is low. In other words, the contrast compensator 630 enhances the contrast ratio of the entire image by compensating for the contrast of the entire image using the average representative value $BLK_{mean}$.

Figure 8:
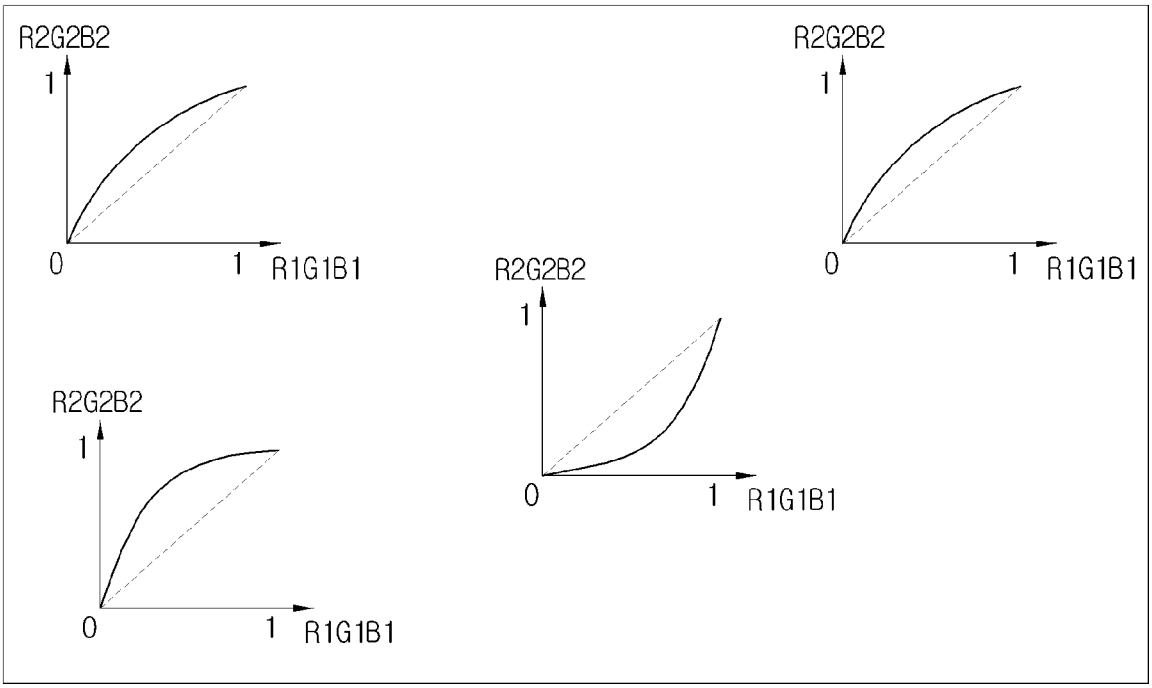

Also, the contrast compensator 630 can compensate for the contrast in each partial area using an interpolation representative value $BLK_{pro}$ output from the interpolator 710, to be explained, based on the second lookup table of FIG. 8.

The interpolator 710 calculates the brightness value $BLK_{sample}$ of each partial area by applying the representative value $BLK_{pro}$ fed from the first calculator 520 to Equation 6, and calculates the interpolation representative value $BLK_{pro}$ which is the interpolated brightness value in the pixel at a certain position by applying a bi-cubic interpolation or a bi-linear interpolation to the acquired brightness value $BLK_{sample}$.

The compensation coefficient calculator 730 calculates a first compensation coefficient $BLK_{LC}$ by applying the interpolation representative value $BLK_{pro}$ output from the interpolator 710 and the pixel luminance value Y input from the pre-processor 400 to Equation 9 below. Herein, the first compensation coefficient $BLK_{LC}$ is a pixel value which compensates to make a dark pixel less dark and to make a bright pixel brighter.

$$BLK_{LC}(i,j)=(Y(i,j))^{\gamma p/BLK_{pro}(i,j)} \quad \text{[Equation 9]}$$

In Equation 9, $BLK_{LC}(i,j)$ denotes the first compensation coefficient of the (i, j)-th pixel, Y(i,j) denotes the luminance value of the pixel at (i, j), and $BLK_{pro}(i,j)$ denotes an interpolation representative value of the pixel at (i, j).

Also, the compensation coefficient calculator 730 calculates a saturation coefficient $BLK_{sat}(i,j)$ of the (i, j)-th pixel by applying the acquired first compensation coefficient $BLK_{LC}$ to Equation 10 below. The saturation coefficient $BLK_{sat}(i,j)$ is a pixel value calculated to reduce artifacts of the image.

$$BLK_{sat}(i,j) = \begin{cases} BLK_{pro}(i,j) - g4 \cdot (Y(i,j))^{\gamma p} - BLK_{pro}(i,j) & \text{if } (Y(i,j))^{\gamma p} > BLK_{pro}(i,j) \\ \text{else} & \\ BLK_{pro}(i,j) & \end{cases} \quad \text{[Equation 10]}$$

In Equation 10, $BLK_{sat}(i,j)$ denotes the saturation coefficient of the (i, j)-th pixel, Y(i,j) denotes the luminance value of the (i, j)-th pixel, $BLK_{pro}(i,j)$ denotes the interpolation representative value of the (i, j)-th pixel, g4 is a preset control parameter, and $\gamma_p$ denotes the preset gamma parameter of the LCD panel. When the value of the pixel luminance value raised to the power of the gamma parameter exceeds the interpolation representative value, the compensation coefficient calculator 730 outputs the value calculated based on the interpolation representative value and the pixel luminance value as the saturation coefficient. When the value of the pixel luminance value raised to the power of the gamma parameter falls below the interpolation representative value, the compensation coefficient calculator 730 outputs the pixel interpolation representative value as the saturation coefficient.

Also, the compensation coefficient calculator 730 calculates a second compensation coefficient $PC_{gain}(i,j)$ by applying the acquired saturation coefficient $BLK_{sat}(i,j)$ and the first compensation coefficient $BLK_{LC}(i,j)$ to Equation 11 below. The second compensation coefficient indicates a gain of the pixel value to be compensated with respect to the luminance value corresponding to the pixel position.

$$PC_{gain}(i,j)=(1/BLK_{sat}(i,j))^{1/\gamma p \cdot BLK_{LC}(i,j)} \quad \text{[Equation 11]}$$

In Equation 11, $PC_{gain}(i,j)$ denotes the second compensation coefficient of the (i, j)-th pixel, $BLK_{sat}(i,j)$ denotes the saturation coefficient of the (i, j)-th pixel, $BLK_{LC}(i,j)$ denotes the first compensation coefficient of the (i, j)-th pixel, and $\gamma_p$ denotes the preset gamma parameter of the LCD panel.

The compensator 750 calculates R3G3B3 pixel value using the second compensation coefficient $PC_{gain}(i,j)$ output from the compensation coefficient calculator 730 and the R2G2B2 pixel value output from the contrast compensator 630. The compensator 750 acquires the R3G3B3 pixel value based on Equation 12 below. The R3G3B3 pixel value is a pixel value which more precisely compensates for the pixel value of the image signal compensated using the R2G2B2 pixel value output from the contrast enhancer 600.

$$\{R3(i,j),G3(i,j),B3(i,j)\}=f(PC_{gain}(i,j)*\{R2(i,j),G2(i,j),B2(i,j)\}) \quad \text{[Equation 12]}$$

In Equation 12, $R3(i,j)$ is the R3 pixel value of the (i, j)-th pixel, $G3(i,j)$ is the G3 pixel value of the (i, j)-th pixel, $B3(i,j)$ is the B3 pixel value of the (i, j)-th pixel, $PC_{gain}(i,j)$ is the second compensation coefficient of the (i, j)-th pixel, and f(x) is a function which limits the value x to 0~1.

That is, the compensator 750 enhances the image quality by compensating for the pixel value of each pixel with the acquired R3G3B3 pixel value.

Figure 9:
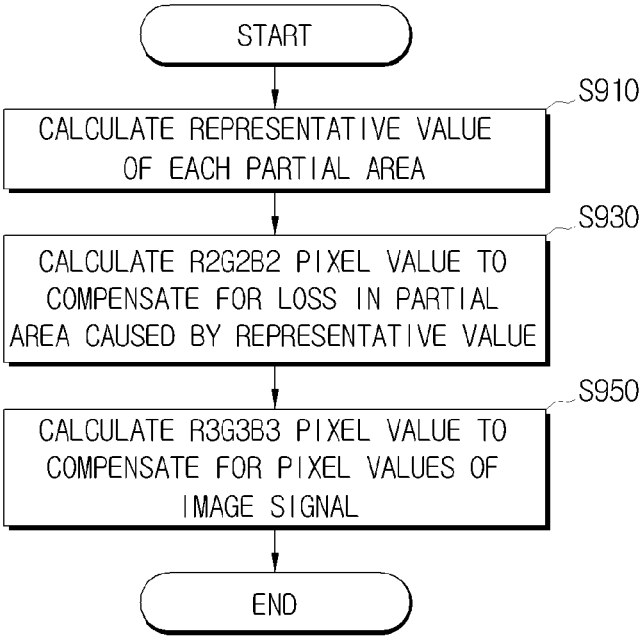
FIG. 9 is a flowchart of a brightness adjusting method of the display apparatus according to an exemplary embodiment of the present invention.

FIG. 9 is a flowchart of a brightness adjusting method of the display apparatus according to an exemplary embodiment of the present invention.

Referring to FIG. 9, the luminance value regulator 500 calculates the representative value $BLK_{out}$ of each partial area (S910).

Specifically, the luminance value regulator 500 calculates the representative value $BLK_{out}$ of the partial area by referring to the input luminance value Y of each pixel and the pre-stored first and second lookup tables. More detailed explanation has been provided by referring to FIGS. 2 through 8 and thus shall be omitted.

Next, the contrast enhancer 600 calculates the R2G2B2 pixel value which compensates for the brightness loss of the partial area caused by the calculated representative value $BLK_{out}$ (S930). In doing so, the contrast enhancer 600 applies the contrast enhancement to not only the entire image but also each partial area.

In more detail, the contrast enhancer 600 increases the contrast ratio of the image signal compromised by the partial area representative value $BLK_{out}$ using the contrast enhancement. To increase the contrast ratio of the image signal compromised by the partial area representative value $BLK_{out}$ the contrast enhancer 600 calculates the R2G2B2 pixel value for compensating for the contrast of the image signal using the interpolation representative value $BLK_{pro}$ and the average representative value $BLK_{mean}$ and compensates for the R1G1B1 pixel value with the calculated R2G2B2 pixel value.

Next, the pixel value compensator 700 calculates the R3G3B3 pixel value which compensates for the pixel values of the image signal to which the contrast enhancement is applied (S950).

In more detail, the pixel value compensator 700 acquires the R3G3B3 pixel value by multiplying the second compensation coefficient calculated based on Equations 9, 10 and 11 by the R2G2B2 pixel value calculated in S930. The pixel value compensator 700 compensates for each pixel value with the acquired R3G3B3 pixel value. For example, the pixel value compensator 700 can compensate for the pixel values of R2, G2 and B2 of the (i, j)-th pixel using R3, G3, B3 of the (i, j)-th respectively.

As set forth above, the brightness loss of the image signal caused by the brightness adjustment of the partial areas and the entire area of the backlight is compensated through the contrast adjustment in the pixel values of the image signal. Therefore, the contrast ratio of the entire image can be improved and the image quality can be enhanced more finely.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A display apparatus comprising:

a panel unit which displays an image signal;

a backlight unit which provides a light to the panel unit to visualize the image signal;

a luminance value regulator which calculates a plurality of representative values to be applied for adjusting a brightness of a plurality of partial areas of the backlight unit corresponding to the image signal;

a contrast enhancer which compensates for a brightness of the image signal compromised by the application of the representative values, through a contrast enhancement; and a pixel value compensator which compensates for pixel values of the image signal compensated through the contrast enhancement.

2. The display apparatus of claim 1, wherein the contrast enhancer compensates for loss of the brightness of the image signal with respect to an entire image and at least one of the plurality of partial areas, through the contrast enhancement.

3. The display apparatus of claim 2, wherein the contrast enhancer compensates for a contrast of the entire image using an average representative value acquired by averaging the representative values of the partial areas, and compensates for the brightness loss of the image in the partial areas using an interpolation representative value acquired by interpolating the representative values of the partial areas through the contrast enhancement.

4. The display apparatus of claim 1, further comprising:

a pre-processor which removes noise in the image signal and calculates a luminance value of a pixel at a certain position in the image signal in which the noise was removed, wherein the luminance value regulator calculates the representative values using an initial representative value acquired by multiplying luminance values of pixels in the partial areas by a pre-stored weight and summing products of the multiplication.

5. The display apparatus of claim 4, wherein the luminance value regulator calculates the initial representative value by applying luminance values of a specific partial area k to the following equation:

$$BLK_{init}(k)=\min(BLK1(k),BLK2(k))$$

where $BLK_{init}(k)$ is an initial representative value in the partial area k, BLK1($k$) is a first luminance value in the partial area k, and BLK2($k$) is a second luminance value in the partial area k.

6. The display apparatus of claim 4, wherein the luminance value regulator calculates the initial representative value by applying luminance values of a specific partial area k to the following equation:

$$BLK_{init}(k)=w1*BLK1(k)+(1-w1)*(BLK2(k))$$

where $BLK_{init}(k)$ is an initial representative value in the partial area k, w1 is a preset weight, BLK1($k$) is a first luminance value in the partial area k, and BLK2($k$) is a second luminance value in the partial area k.

7. The display apparatus of claim 4, wherein the luminance value regulator comprises:

a first calculator which calculates a first brightness value for compensate the image signal, by summing products of the initial representative values of the partial areas multiplied by pre-stored optical profile data;

a first regulator which calculates a first adjustment value for adjusting brightness of the image signal using the first brightness value calculated at the first calculator, the initial representative values, and a preset maximum luminance value;

a second calculator which calculates a second brightness value for compensating the image signal of which the brightness is adjusted by the first regulator, wherein the second brightness value is a brightness value after scaling the first brightness value; and a second regulator which calculates a second adjustment value for adjusting the brightness of the image signal, of which the brightness is adjusted using the first adjustment value, using the second brightness value calculated at the second calculator, the first adjustment value, and the maximum luminance value.

8. The display apparatus of claim 4, wherein the luminance value regulator comprises:

a first calculator which calculates a first brightness value which is a brightness value in a specific partial area of the image signal after scaling the image signal;

a first regulator which calculates a first adjustment value for adjusting the brightness of the image signal in the specific partial area;

a second calculator which calculates a second brightness value which is a brightness value in partial areas adjacent to the specific partial area of the image signal; and a second regulator which calculates a second adjustment value for adjusting the brightness of the image signal in the partial areas adjacent to the specific partial area of the image signal.

9. The display apparatus of claim 8, wherein the luminance value regulator further comprises:

a space filter which space-filters the partial area of which the brightness is adjusted using the second adjustment value; and a time filter which time-filters the space-filtered partial area.

10. The display apparatus of claim 1, wherein the pixel value compensator comprises:

an interpolator which calculates a brightness value of each partial area from the respective representative value, and calculates an interpolation representative value which is an interpolated brightness value of a pixel at a certain position by applying one of a bi-cubit interpolation and a bi-linear interpolation to the calculated brightness value;

a compensation coefficient calculator which calculates a compensation coefficient for compensating the pixel values of the image signal using the interpolation representative value and a luminance value of the pixels of the partial area; and a compensator which compensates for the pixel values of the image signal of which contrast is enhanced, by multiplying the compensation coefficient by the pixel values used to enhance the contrast at the contrast enhancer.

11. The display apparatus of claim 10, wherein the compensation coefficient calculator calculates a first compensation coefficient by applying the interpolation representative value to the following equation:

$$BLK_{LC}(i,j)=(Y(i,j))^{\gamma_p/BLK_{pro}(i,j)}$$

where $BLK_{LC}(i, j)$ is the first compensation coefficient of an (i, j)-th pixel, Y(i, j) is a luminance value of the pixel at (i, j), $BLK_{pro}(i, j)$ is an interpolation representative value of the pixel at (i, j), and $\gamma_p$ is a preset gamma parameter, the compensation coefficient calculator calculates a saturation coefficient by applying the first compensation coefficient to the following equation:

$$BLK_{sat}(i, j) = \begin{cases} BLK_{pro}(i, j) - g4 \cdot (Y(i, j))^{\gamma_p} - BLK_{pro}(i, j) & \text{if } (Y(i, j))^{\gamma_p} > BLK_{pro}(i, j) \\ \text{else} \\ BLK_{pro}(i, j) \end{cases}$$

where $BLK_{sat}(i, j)$ is a saturation coefficient of the (i, j)-th pixel, Y(i, j) is the luminance value of the (i, j)-th pixel, $BLK_{pro}(i, j)$ is the interpolation representative value of the (i, j)-th pixel, g4 is a preset control parameter, and $\gamma_p$ is the preset gamma parameter, and the compensation coefficient calculator calculates the compensation coefficient used to compensate for the pixel values of the image signal by calculating a second compensation coefficient by applying the saturation coefficient to the following equation:

$$PC_{gain}(i,j)=(1/BLK_{sat}(i,j))^{1/\gamma_p BLK_{LC}(i,j)}$$

where $PC_{gain}(i, j)$ is a second compensation coefficient of the (i, j)-th pixel, $BLK_{sat}(i, j)$ is the saturation coefficient of the (i, j)-th pixel, $BLK_{LC}(i, j)$ is the first compensation coefficient of the (i, j)-th pixel, and $\gamma_p$ is the preset gamma parameter.

12. The display apparatus of claim 1, wherein the pixel value compensator compensates for the pixel values of the image signal by adjusting the pixel values to make a dark pixel less dark and make a bright pixel brighter among pixels of the image signal compensated using the contrast enhancement.

13. A brightness adjusting method of a display apparatus, the method comprising:

calculating a plurality of representative values to be applied for adjusting a brightness of a plurality of partial areas of a luminous element which produces light to a panel, corresponding to an input image signal;

compensating for a brightness of the image signal compromised by the application of the representative values through a contrast enhancement; and compensating for pixel values of the image signal compensated through the contrast enhancement.

14. The brightness adjusting method of claim 13, wherein the compensating for the brightness of the image signal comprises compensating for loss of the brightness of the image signal with respect to the entire image and at least one of the plurality of partial areas of the image, through the contrast enhancement.

15. The brightness adjusting method of claim 14, wherein the compensating for the brightness of the image signal comprises compensating for a contrast of the entire image using an average representative value acquired by averaging the representative values of the partial areas, and compensating for the brightness loss of the image using an interpolation representative value acquired by interpolating the representative values of the partial areas through the contrast enhancement.

16. The brightness adjusting method of claim 13, further comprising:

before the calculating the representative values, removing noise from the image signal and calculating a luminance value of a pixel at a certain position in the noise-free image signal, wherein the calculating the representative values comprises calculating the representative values using an initial representative value acquired by multiplying luminance values of pixels in the partial areas by a pre-stored weight and summing the products of the multiplication.

17. The brightness adjusting method of claim 16, wherein the calculating the representative values comprises calculating the initial representative value by applying luminance values of a specific partial area k to the following equation:

$$BLK_{init}(k)=\min(BLK1(k),BLK2(k))$$

where $BLK_{init}(k)$ is an initial representative value in the partial area k, BLK1($k$) is a first luminance value in the partial area k, and BLK2($k$) is a second luminance value in the partial area k.

18. The brightness adjusting method of claim 16, wherein the calculating the representative values comprises calculating the initial representative value by applying luminance values of a specific partial area k to the following equation:

$$BLK_{init}(k)=w1*BLK1(k)+(1-w1)*(BLK2(k)) \quad \text{[Equation 5]}$$

where $BLK_{init}(k)$ is an initial representative value in the partial area k, w1 is a preset weight, BLK1($k$) is a first luminance value in the partial area k, and BLK2($k$) is a second luminance value in the partial area k.

19. The brightness adjusting method of claim 16, wherein the calculating the representative values comprises:

calculating a first brightness value for compensating the image signal, by summing products of the initial representative values of the partial areas multiplied by pre-stored optical profile data;

calculating a first adjustment value for adjusting brightness of the image signal using the calculated first brightness value, the initial representative values, and a preset maximum luminance value;

calculating a second brightness value, which is a brightness value after scaling the first brightness value, for compensating the image signal of which the brightness is adjusted using the first adjustment value; and calculating a second adjustment value for adjusting the brightness of the image signal, of which the brightness is adjusted using the first adjustment value, using the calculated second brightness value, the first adjustment value, and the maximum luminance value.

20. The brightness adjusting method of claim 16, wherein the first operation comprises:

calculating a first brightness value which is a brightness value in a specific partial area of the image signal after scaling the image signal;

calculating a first adjustment value for adjusting the brightness of the image signal in the specific partial area;

calculating a second brightness value which is a brightness value in partial areas adjacent to the specific partial area of the image signal; and calculating a second adjustment value for adjusting the brightness of the image signal in the partial areas adjacent to the specific partial area of the image signal.

21. The brightness adjusting method of claim 20, wherein the first operation further comprises:

space-filtering the partial area of which the brightness is adjusted using the second adjustment value; and time-filtering the space-filtered partial area.

22. The brightness adjusting method of claim 13, wherein the third operation comprises:

calculating a brightness value of each partial area from the respective representative value, and calculating an interpolation representative value which is an interpolated brightness value of a pixel at a certain position by applying one of a bi-cubit interpolation and a bi-linear interpolation to the calculated brightness value;

calculating a compensation coefficient used to compensate for the pixel values of the image signal using the interpolation representative value and a luminance value of the pixels of the partial area; and compensating for the pixel values of the image signal of which contrast is enhanced, by multiplying the compensation coefficient by the pixel values used to enhance the contrast.

23. The brightness adjusting method of claim 22, wherein the calculating the compensation coefficient calculates a first compensation coefficient by applying the interpolation representative value to the following equation:

$$BLK_{LC}(i,j)=(Y(i,j))^{\gamma_p/BLK_{pro}(i,j)}$$

where $BLK_{LC}(i, j)$ is the first compensation coefficient of an (i, j)-th pixel, Y(i, j) is a luminance value of the pixel at (i, j), $BLK_{pro}(i, j)$ is an interpolation representative value of the pixel at (i, j), and $\gamma_p$ is a preset gamma parameter, the calculating the compensation coefficient calculates a saturation coefficient by applying the first compensation coefficient to the following equation:

$$BLK_{sat}(i,j)=\begin{cases} BLK_{pro}(i,j)-g4\cdot(Y(i,j))^{\gamma_p}-BLK_{pro}(i,j) & \text{if } (Y(i,j))^{\gamma_p}>BLK_{pro}(i,j) \\ \text{else} & \\ BLK_{pro}(i,j) & \end{cases}$$

where $BLK_{sat}(i, j)$ is a saturation coefficient of the (i, j)-th pixel, Y(i, j) is the luminance value of the (i, j)-th pixel, $BLK_{pro}(i, j)$ is the interpolation representative value of the (i, j)-th pixel, g4 is a preset control parameter, and $\gamma_p$ is the preset gamma parameter, and the calculating the compensation coefficient calculates the compensation coefficient used to compensate for the pixel values of the image signal by calculating a second compensation coefficient by applying the saturation coefficient to the following equation:

$$PC_{gain}(i,j)=(1/BLK_{sat}(i,j))^{1/\gamma_p,BLK_{LC}(i,j)}$$

where $PC_{gain}(i, j)$ is a second compensation coefficient of the (i, j)-th pixel, $BLK_{sat}(i, j)$ is the saturation coefficient of the (i, j)-th pixel, $BLK_{LC}(i, j)$ is the first compensation coefficient of the (i, j)-th pixel, and $\gamma_p$ is the preset gamma parameter.

24. The brightness adjusting method of claim 13, wherein the third operation compensates for the pixel values of the image signal by adjusting the pixel values to make a dark pixel less dark and make a bright pixel brighter among pixels of the image signal compensated using the contrast enhancement.

25. The brightness adjusting method of claim 13, further comprising:

after the third operation, dithering a flickering of the image signal of which the pixel values are compensated in the third operation, and adjusting a white balance.

26. The display apparatus of claim 1, wherein the luminance value regulator outputs the plurality of representative values, and the contrast enhancer receives the plurality of representative values output from the luminance value regulator, and compensates for the brightness of the image signal for each of the plurality of partial areas of the backlight compromised by the application of the plurality of representative values based on the plurality of representative values.

27. The display apparatus of claim 26, wherein the contrast enhancer outputs a first pixel value of the image signal enhanced by the contrast enhancement, and the pixel value compensator receives the first pixel value from the contrast enhancer and calculates a second pixel value which compensates for the first pixel value based on the first pixel value.

28. The display apparatus of claim 1, wherein the luminance value regulator outputs the plurality of representative values, and the pixel value compensator receives the plurality of representative values output from the luminance value regulator, and calculates a plurality of compensated pixel values based on the plurality of representative values for compensating the pixel values of the image signal output by the contrast enhancer.

29. The brightness adjusting method of claim 13, wherein the compensating for the brightness of the image signal comprises receiving the plurality of representative values, and compensating for the brightness of the image signal for each of the plurality of partial areas of the backlight compromised by the application of the plurality of representative values based on the plurality of representative values.

30. The brightness adjusting method of claim 29, wherein the compensating for the pixel values of the image signal compensated through the contrast enhancement comprises receiving a first pixel value of the image signal enhanced by the contrast enhancement, and calculating a second pixel value which compensates for the first pixel value based on the first pixel value.

31. The brightness adjusting method of claim 13, wherein the compensating for the brightness of the image signal comprises receiving the plurality of representative values, and calculating a plurality of compensated pixel values based on the plurality of representative values for compensating the pixel values of the image signal output by the contrast enhancement.

* * * * *